United States Patent [19]

Stadheim

[11] 4,442,643

[45] Apr. 17, 1984

[54] VENT PIPE INSULATING SLEEVE

[76] Inventor: James S. Stadheim, R.R. 2, Watertown, S. Dak. 57201

[21] Appl. No.: 256,776

[22] Filed: Apr. 23, 1981

[51] Int. Cl.[3] ..... E04F 17/04; E04D 13/14

[52] U.S. Cl. ..... 52/219; 52/199; 98/122; 285/44

[58] Field of Search ..... 98/122; 52/219, 199; 4/218; 285/44

[56] References Cited

U.S. PATENT DOCUMENTS

| | | | |
|---|---|---|---|
| 1,010,100 | 11/1911 | Wallace | 285/44 X |
| 2,133,376 | 10/1938 | Brown | 52/219 X |
| 2,956,495 | 10/1960 | Sublette | 52/219 X |
| 3,783,570 | 1/1974 | Storch | 52/219 X |
| 4,115,961 | 9/1978 | Bishop | 52/58 |
| 4,168,726 | 9/1979 | Klennert | 98/122 X |

FOREIGN PATENT DOCUMENTS

| | | | |
|---|---|---|---|
| 881850 | 9/1971 | Canada | 98/122 |
| 2600916 | 7/1977 | Fed. Rep. of Germany | 52/219 |

*Primary Examiner*—Alfred C. Perham
*Attorney, Agent, or Firm*—Harvey B. Jacobson

[57] ABSTRACT

An insulating sleeve designed for positioning over a sewer vent pipe associated with a dwelling includes a tubular-shaped member constructed of insulating material which is covered by a protective outer shell. Additionally, the ends of the sleeve are provided with watertight seals and a roof shield may be utilized to effectively attach the sleeve to a roof. The sleeve is designed to prevent frost and snow buildup within a sewer vent pipe in cold climates.

4 Claims, 5 Drawing Figures

Fig. 2
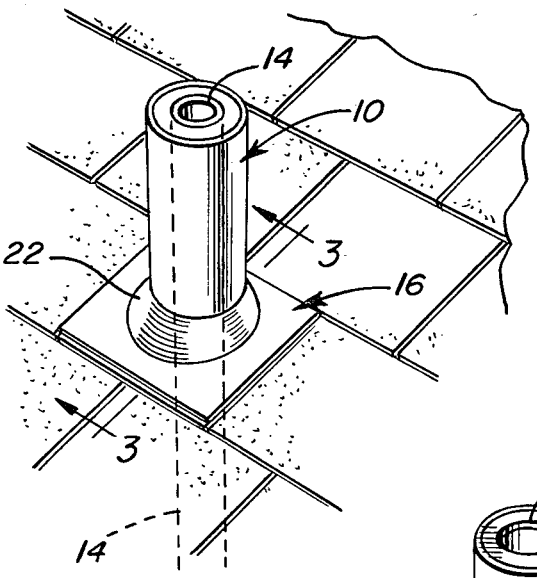
Fig. 3
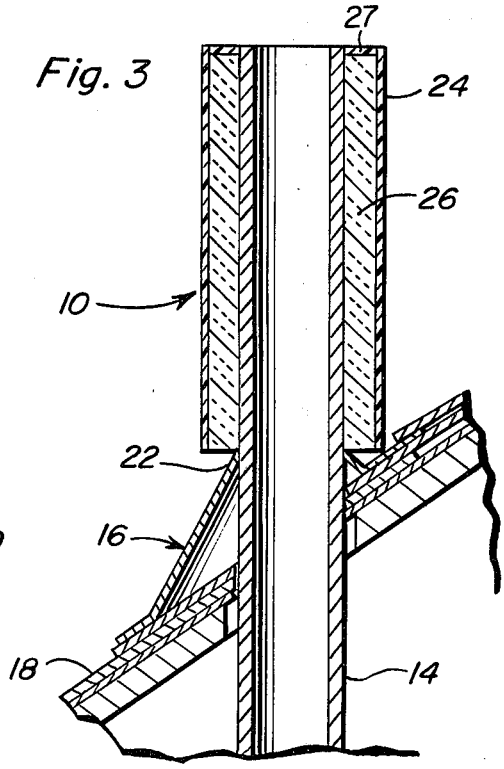
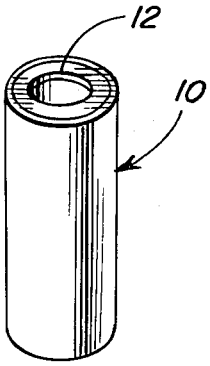
Fig. 1
Fig. 4
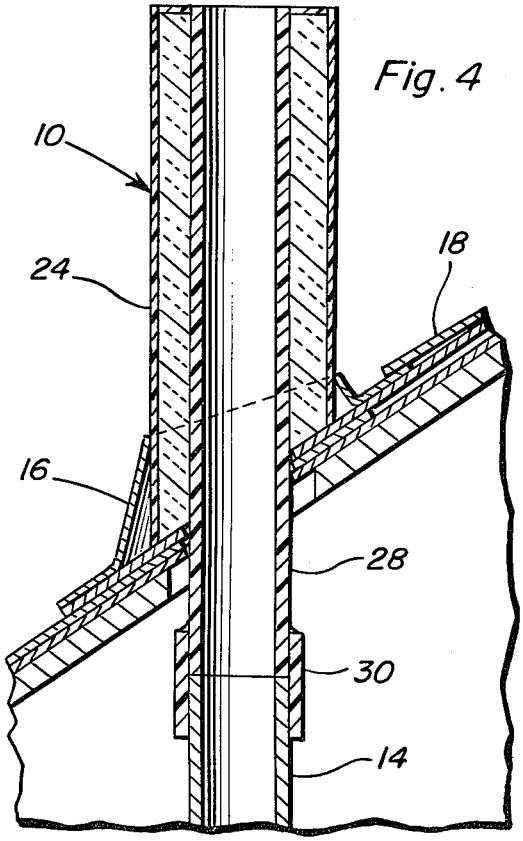
Fig. 5
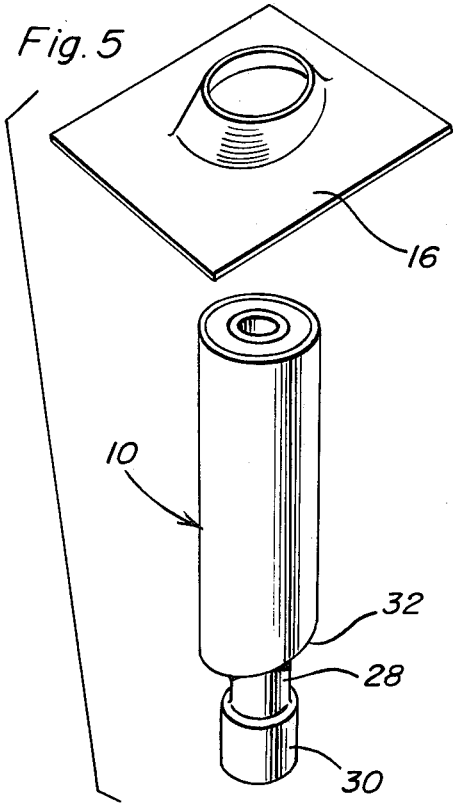

VENT PIPE INSULATING SLEEVE

BACKGROUND OF THE INVENTION

1. Field of the Invention

The present invention relates generally to insulating sleeves and more particularly pertains to an insulating sleeve designed for use in conjunction with sewer vent pipes in cold climates.

2. Description of the Prior Art

An ongoing problem in cold weather climates is frost accumulation in sewer vent pipes. This problem has magnified in recent years as a result of homeowners installing indoor plumbing and utilizing large quantities of hot water to perform daily chores. Inasmuch as hot water usage is on the increase due to the use of more automatic washing machines, dishwashers, etc., the problem most certainly will continue to get worse. Specifically, the extra hot water usage generates a lot of steam which is normally exhausted through a sewer vent pipe, and where the weather is extremely cold, an increased amount of steam escaping through a vent pipe results in more rapid frost buildup.

In the worse case, frost buildup will completely seal a vent pipe, thus preventing air from moving into or out of the pipe, and as a result, when a toilet is flushed, the fast discharge of water with no air behind it causes the sewer traps in bathtubs and sinks to be sucked dry. As such, sewer gas may move from the sewer system into a dwelling, thus endangering its occupants. In this respect, there have been a number of instances where sewer gas accumulation within a residence has resulted in the death of the occupants thereof. By the same token, many injuries have resulted where people have fallen from roofs while trying to thaw out their sewer vent pipes.

Inasmuch as the problem has been recognized, there have been a number of attempts to deal with it although not very successfully. For example, U.S. Pat. No. 3,579,930, issued to Murphy on May 25, 1971, discloses a snow deflector unit which is effectively a triangularly-shaped metal structure having sidewall vents and being designed for attachment to a roof over a vent pipe in a manner whereby snow cannot accumulate within the vent pipe. However, the Murphy device is difficult to mount to a roof and doesn't really effectively insulate a sewer vent pipe from frost buildup.

At least one attempt has been made to construct a protector for sewer ventilation pipes which is directly mountable to a roof in a concentric relationship with the vent pipe to be insulated. In this regard, reference is made to U.S. Pat. No. 346,714, issued to Boyd on Aug. 3, 1886, wherein there is disclosed a protective sleeve for mounting over the end of a sewer ventilation pipe and being attachable to a roof, such sleeve consisting of a pair of concentrically mounted cylinders which are cast as one piece. Specifically, one of the cylinders is of a much greater diameter than the other, whereby a dead-air space is contained between the cylinders, with the innermost cylinder then being positionable over the aforementioned sewer ventilation pipe. As such, the protector of Boyd allegedly prevents frost accumulation through the use of the dead-air space positioned between the concentric cylinders. However, dead air is a poor insulator and it is highly unlikely that frost accumulation would be prevented in cold climates through a use of the Boyd device.

Accordingly, it can be appreciated that there exists a continuing need for preventing frost buildup in sewer vent pipes in cold climates and in this respect, the present invention substantially fulfils this need.

SUMMARY OF THE INVENTION

The general purpose of the present invention, which will be described subsequently in greater detail, is to provide an insulating sleeve for sewer vent pipes operable to prevent frost buildup therein which has all the advantages of the prior art insulating means for sewer ventilation pipes and none of the disadvantages. To attain this, the present invention provides a tubular-shaped sleeve constructed of insulating material, such as polystyrene, urethane, or the like, which may be easily and quickly slipped over an end of a sewer ventilation pipe extending outwardly from the roof of a dwelling. Additionally, the sleeve may be provided with a protective outer shell to prevent damage to the insulation associated therewith, such outer shell being constructed of a thin layer of plastic or fiber glass, while respective ends of the sleeve may be provided with watertight seals to further prevent damage thereto. Further, a roof shield conformingly positionable over the sleeve may be utilized to effect a secure attachment of the sleeve to a roof.

It is therefore an object of the present invention to provide an improved insulating sleeve for use on a sewer vent pipe which has all the advantages of similarly employed prior art insulating sleeves and none of the disadvantages.

It is another object of the present invention to provide an improved insulating sleeve for use on a sewer vent pipe which may be easily and economically manufactured.

It is a further object of the present invention to provide an improved insulating sleeve for use on a sewer vent pipe which is both simple in construction and limited in the number of moving parts.

Still another object of the present invention is to provide an improved insulating sleeve for use on a sewer vent pipe which performs its function in an efficient and reliable manner.

Yet another object of the present invention is to eliminate the danger of frost buildup in sewer vent pipes which extend outwardly from occupant-inhabited dwellings.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the insulating sleeve forming the present invention.

FIG. 2 is a perspective view of the insulating sleeve shown in FIG. 1 operably installed over a sewer vent pipe extending outwardly from a roof.

FIG. 3 is a cross-sectional view of the present invention illustrating the manner of attachment of the same to a sewer pipe associated with an existing structure, such view being taken along the line 3—3 of FIG. 2.

FIG. 4 is a cross-sectional view of a modified embodiment of the present invention whereby the same could be incorporated into a dwelling during the construction thereof.

FIG. 5 is an exploded view of the embodiment of the present invention illustrated in FIG. 4.

DESCRIPTION OF THE PREFERRED EMBODIMENTS

With reference now to the drawings and in particular to FIGS. 1 and 2 thereof, an insulating sleeve assembly for protecting against frost buildup in a sewer vent pipe embodying the principles and concepts of the present invention and generally designated by the reference numeral 10 will be described. In this respect, it can be seen that the insulating sleeve assembly 10 is of a tubular construction having a longitudinally directed, through-extending, centrally positioned aperture 12 which serves to facilitate a positioning of the sleeve assembly over a sewer vent pipe 14. As better illustrated in FIG. 2, the insulating sleeve assembly 10 may be slipped down over the vent pipe 14 until contact is made with a conventional roof shield 16 which normally serves as a transition piece and seal between the roof 18 and the sewer vent pipe. In this regard, any conventional manner of attaching the sleeve 10 to the roof shield 16 or the pipe 14 may be utilized, such as glueing, stapling, etc.

FIG. 3 illustrates a first embodiment of the present invention which may be utilized on existing construction, i.e., where a dwelling is already constructed and has a sewer vent pipe 14 extending outwardly therefrom, such dwelling not being presently provided with insulating or other means for preventing frost buildup in its vent pipe. In this regard, it can be seen that the sewer vent pipe 14 normally extends through a roof 18 whereby an end portion of the vent pipe is exposed to a free flow of air, thereby facilitating the exhaust of sewer gases upwardly through the ventilation pipe. As shown, the cylindrically-shaped insulating sleeve assembly 10 may be slipped down over the sewer vent pipe 14 until the same is brought into engagement with the conically-shaped top portion 22 of the roof shield 16. In this connection, it can be seen that the through-extending aperture 12 associated with the insulating sleeve 10 is of a diameter substantially similar to the outer diameter of the sewer vent pipe 14, whereby a close conforming and concentric fit between the insulating sleeve assembly and the exterior surface of the vent pipe is achieved. As aforementioned, the sleeve 10 may be attached to the roof shield 16 or pipe 14 in any conventional manner.

As to the construction of the insulating sleeve, it can be seen that the same may be provided with an outer protective sleeve cover 24 positionable over an inner insulating sleeve body 26, while the same cover may also include an annular upper end wall 27 lapped over the upper sleeve body end so as to form watertight seals thereover. Typically, it is expected that the insulating sleeve body 26 of the insulating sleeve assembly 10 will be constructed of polystyrene, urethane, or the like, while the outer protective cover 24 may be constructed of a thin layer of plastic or fiberglass, or any other material which is weather and wear resistant. However, the present invention envisions no use of metal as a protective cover, regardless of the wear resistance associated therewith, since metal tends to quickly conduct heat to the atmosphere. In other words, whatever materials are employed in the construction of the present invention should have good insulating qualities, and metal does not possess these qualities. As to the watertight construction provided on the ends of the insulating sleeve assembly 10, such watertight sealing may be provided by means other than utilizing the protective cover 24, and in this respect, any known watertight sealing means may be provided.

FIGS. 4 and 5 illustrate a second embodiment of the present invention which is ideally constructed for use in new construction, i.e., in dwellings where the sewer ventilation pipes may be designed for specific use with a frost preventing insulation sleeve. Specifically, it can be seen that the sewer ventilation pipe 14 might be constructed of poly-vinyl-chloride pipe (PVC) whereby the insulating sleeve assembly 10 may come provided with a downwardly extending attachment portion 28. In this respect, a length of PVC piping may be utilized to construct the downwardly extending attachment portion 28 and may be further provided with a PVC coupling 30, while an end 32 of the insulating sleeve assembly 10 may be diagonally cut prior to its installation on a dwelling. Specifically, in new construction, it would be expected that the angle of the roof 18 would be known in advance whereby the end portion 32 of the insulating sleeve assembly 10 could be cut to conformingly fit relative thereto, and the downwardly extending attachment portion 28 along with its coupling 30 would facilitate an easy attachment of the invention directly to a PVC vent pipe 14 as shown in FIG. 4. Of course, PVC pipe is normally attached through the use of a special glue and accordingly, it would not be necessary to extend a sewer vent pipe upwardly through a roof in the manner illustrated in FIG. 3.

FIGS. 4 and 5 additionally illustrate a modified embodiment of a conventional roof shield 16 whereby the same is designed to conformingly fit around the outer peripheral surface of the insulating sleeve assembly 10 as opposed to an outer peripheral surface of a vent pipe 14. Of course, this modified embodiment of the roof shield 16 could be utilized in either existing or new construction, i.e., with either of the two embodiments of the present invention.

From FIG. 3, it will be noted that the insulating sleeve body 26 at least substantially fills the annular area defined between the opposing outer surfaces of the pipe 14 and the inner surfaces of the outer sleeve 24. Further, the sleeve assembly 10 is free of portions extending across the upper end thereof in registry with the upper end of pipe 14, whereby there exists no obstruction to the gentle egress of vented gases from the pipe upper end and maximum heating of the pipe upper end and minimum condensation of moisture occurs within the pipe upper end as a result of unobstructed venting of sewer gas upwardly through the pipe 14. Further, such an obstruction, even partial, undoubtedly would include some surface portions thereof exposed to the cold ambient air and upon which water could condense and subsequently freeze.

As such, an apparatus for insulating a sewer vent pipe which will allow warm moist air to escape before freezing has been described. In effect, the present invention comprises a slip over sleeve made from expanded, beaded polystyrene, and the plastic cover or light coating of fiberglass covering the polystyrene serves to protect the same from birds, hail, etc. Additionally, the lengths of the insulating sleeve assembly 10 will vary because of state codes requiring vent pipes of different heights above roofs, and the diameters may be varied to fit all sizes of vent pipes, while the sleeve insulating body per se should be at least one inch thick. With respect to the above description then, it should be realized that the optimum dimensional relationships of the parts of the invention are deemed readily apparent and obvious to one who is skilled in the art to which the invention pertains, and all equivalent relationships to those illustrated in the drawings and described in the specification, to include modification of form, size, arrangement of parts and details of operation, are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with an upstanding sewer vent pipe projecting upwardly through a roof structure and terminating upwardly a spaced distance above the portion of the roof structure through which said vent pipe projects, said vent pipe being subject to upward flow of high humidity air and sewer gas therethrough and a build up of accumulated ice thereacross as a result of condensation and ice build up within said upper end portion during periods of very cold ambient temperature, an insulation sleeve assembly for preventing said build up solely through utilization and prevention of loss of the inherent heat of vented high humidity sewer gas, said assembly including an outer sleeve of waterproof material, an inner sleeve body of heat insulative material snugly received within, extending the full length of and supported from said outer sleeve, the upper end of said outer sleeve including an annular upper end portion lapped over the upper end of said inner sleeve body, said sleeve assembly being snugly telescoped over substantially the entire upper end portion of said vent pipe projecting above said roof structure with said inner sleeve at least substantially filling annular area defined between the outer surfaces of said pipe and the inner surfaces of said outer sleeve, said outer sleeve and annular upper end portion being of non-metallic low heat conductive construction, said sleeve assembly being of portions extending across the upper end thereof in registry with the upper end of said pipe, whereby there exists no obstruction to the gentle egress of vented gases from the pipe upper end and maximum heating of the pipe upper end and minimum condensation of moisture occurs within the pipe upper end as result of unobstructed venting of sewer gases upwardly through said pipe.

2. The combination of claim 1 including roof shield means effecting an attachment between said sleeve assembly and said roof structure so as to form a watertight seal between said roof structure and said sleeve.

3. The combination of claim 1 wherein the lower ends of said outer sleeve and inner sleeve body are diagonally tapered relative to the longitudinal axis of said sleeve assembly, said roof structure being inclined relative to the longitudinal axis of said vent pipe, the diagonal tapering of the lower end of said outer sleeve and inner sleeve body conforming to the inclination of said roof structure.

4. The combination of claim 3 wherein the upper end portion of said vent pipe is sealed relative to said annular upper end portion of said outer sleeve and projects downwardly through said roof structure and is coupled to a portion of said vent pipe terminating upwardly below said roof structure.

* * * * *